US010436085B2

(12) United States Patent
Pompucci

(10) Patent No.: US 10,436,085 B2
(45) Date of Patent: Oct. 8, 2019

(54) ROAD VEHICLE WITH AN INTERNAL COMBUSTION ENGINE AND PROVIDED WITH A DEVICE FOR THE TRANSMISSION OF THE EXHAUST NOISE

(71) Applicant: Ferrari S.p.A., Modena (IT)

(72) Inventor: Cristiano Pompucci, Modena (IT)

(73) Assignee: Ferrari S.p.A., Modena (IT)

( * ) Notice: Subject to any disclaimer, the term of this patent is extended or adjusted under 35 U.S.C. 154(b) by 243 days.

(21) Appl. No.: 15/610,956

(22) Filed: Jun. 1, 2017

(65) Prior Publication Data

US 2017/0350287 A1 Dec. 7, 2017

(30) Foreign Application Priority Data

Jun. 3, 2016 (IT) ..... 102016000057222

(51) Int. Cl.

| | |
|---|---|
| ***F01N 1/02*** | (2006.01) |
| ***F01N 1/16*** | (2006.01) |
| ***F01N 13/08*** | (2010.01) |
| ***G10K 11/22*** | (2006.01) |
| ***F01N 13/04*** | (2010.01) |
| ***F01N 1/06*** | (2006.01) |

(52) U.S. Cl.

CPC ..... *F01N 1/023* (2013.01); *F01N 1/06* (2013.01); *F01N 1/166* (2013.01); *F01N 1/168* (2013.01); *F01N 13/04* (2013.01); *F01N 13/082* (2013.01); *G10K 11/22* (2013.01); *F01N 2260/16* (2013.01)

(58) Field of Classification Search

CPC ..... F01N 13/04; F01N 13/082; F01N 1/023; F01N 1/06; F01N 1/166; F01N 1/168; F01N 2260/16; G10K 11/22

See application file for complete search history.

(56) References Cited

U.S. PATENT DOCUMENTS

| | | | | |
|---|---|---|---|---|
| 8,127,888 B1 | 3/2012 | Mah | | |
| 2007/0193251 A1* | 8/2007 | Leseman | F01N 1/24 | 60/272 |

FOREIGN PATENT DOCUMENTS

| | | | |
|---|---|---|---|
| DE | 100 42 012 A1 | | 5/2001 |
| DE | 102010005067 | * | 7/2011 |
| DE | 102012109668 | * | 1/2014 |
| DE | 10 2012 109 668 A1 | | 4/2014 |

* cited by examiner

*Primary Examiner* — Audrey K Bradley
*Assistant Examiner* — Diem T Tran
(74) *Attorney, Agent, or Firm* — Blank Rome LLP

(57) ABSTRACT

A road vehicle comprising: a passenger compartment; an internal combustion engine; an exhaust system, which releases into the atmosphere the gases generated by the combustion, is connected to the internal combustion engine, and ends with at least one silencer having at least one outlet pipe; and an exhaust noise transmission device, which is provided with a transmission conduit, which originates close to the outlet pipe of the silencer, ends in the area of a wall of the passenger compartment, and is provided, on the inside, with at least one insulating element, which is arranged inside the transmission conduit so as to tightly seal the transmission conduit.

10 Claims, 7 Drawing Sheets

ROAD VEHICLE WITH AN INTERNAL COMBUSTION ENGINE AND PROVIDED WITH A DEVICE FOR THE TRANSMISSION OF THE EXHAUST NOISE

PRIORITY CLAIM

This application claims priority from Italian Patent Application No. 102016000057222 filed on Jun. 3, 2016, the disclosure of which is incorporated by reference.

TECHNICAL FIELD

The present invention relates to a road vehicle with an internal combustion engine and provided with a device for the transmission of the exhaust noise.

The present invention advantageously applies to a high-performance sports car, to which the present invention finds advantageous application without thereby losing generality.

PRIOR ART

In a high-performance sports car the noise of the internal combustion engine that is perceived inside the passenger compartment is important.

An important component in the judgment of a high-performance sports car is the "quality" of the sound emitted from the exhaust (not only and not so much in terms of intensity of the sound, but above all in terms of "pleasantness" of the sound itself), i.e. the degree of satisfaction in the use of a high-performance sports vehicle is also significantly affected by the "quality" of the sound emitted from the exhaust. In order to be able to effectively control the sound emitted from the exhaust, several high-performance sports cars have an exhaust system with a variable geometry, i.e. an exhaust system provided with one or more electrically or pneumatically controlled valves, which allow the path of the exhaust gases (and therefore of the sound) to be modified along the exhaust system; consequently, in use, the electronic control unit of the engine changes the geometry of the exhaust system in real time to always try to offer an exhaust sound corresponding to the expectations of the car users and of course compatibly with the achievement of the type-approval targets as for the exhaust noise level intensity.

In general, turbocharged engines are penalised since the presence of the turbine along the exhaust pipe and of the compressor along the intake pipe add a filter and a lowering of the sound levels from both exhaust and intake.

In addition, the latest EURO6C type-approval standards for pollutant emissions require the use of exhaust gas treatment devices that significantly affect the sound performance, since an anti-particulate filter (called GPF that stands for "Gasoline Particulate Filter") must be located in series to the catalyst, even in the case of petrol engines.

To improve the perceived noise of the internal combustion engine inside the passenger compartment, devices for amplifying the intake noise have been proposed, for example as described in U.S. Pat. No. 7,975,802B2 or in U.S. Pat. No. 8,127,888B1. A known device for the transmission of the intake noise comprises an amplification pipe originating in the intake pipe between the air filter and the inlet valve, and has an outlet opening which is free and points towards the passenger compartment; the amplification pipe houses a membrane, which serves the purpose of sealing the intake pipe with respect to the external environment and is carried by a bellows to be free to vibrate so as to generate sound waves under the thrust of the pressure waves present in the intake pipe.

To improve the perceived noise of the internal combustion engine inside the passenger compartment, devices for amplifying the exhaust noise have been proposed, for example as described in patent application DE102012109668A1 or in patent application DE10042012A1. A known device for the transmission of the exhaust noise comprises a transmission conduit, which originates in the area of a pipe of the exhaust system that releases into the atmosphere the gases generated by the combustion, ends in the area of the passenger compartment, and is provided, on the inside, with an insulating membrane that pneumatically seals the said transmission conduit.

DESCRIPTION OF THE INVENTION

The object of the present invention is to provide a road vehicle with an internal combustion engine and provided with a device for the transmission of the exhaust noise, which road vehicle is easy and inexpensive to manufacture and free from the drawbacks described above, i.e. allows for perceiving within the passenger compartment an exhaust noise which is natural and overall pleasant according to the expectations of the driver and any passengers.

According to the present invention, a road vehicle with an internal combustion engine and provided with a device for the transmission of the exhaust noise is provided as claimed in the appended claims.

BRIEF DESCRIPTION OF THE DRAWINGS

The present invention will now be described with reference to the accompanying drawings, which illustrate a non-limiting embodiment thereof, in which.

PREFERRED EMBODIMENTS OF THE INVENTION

Figure 1:
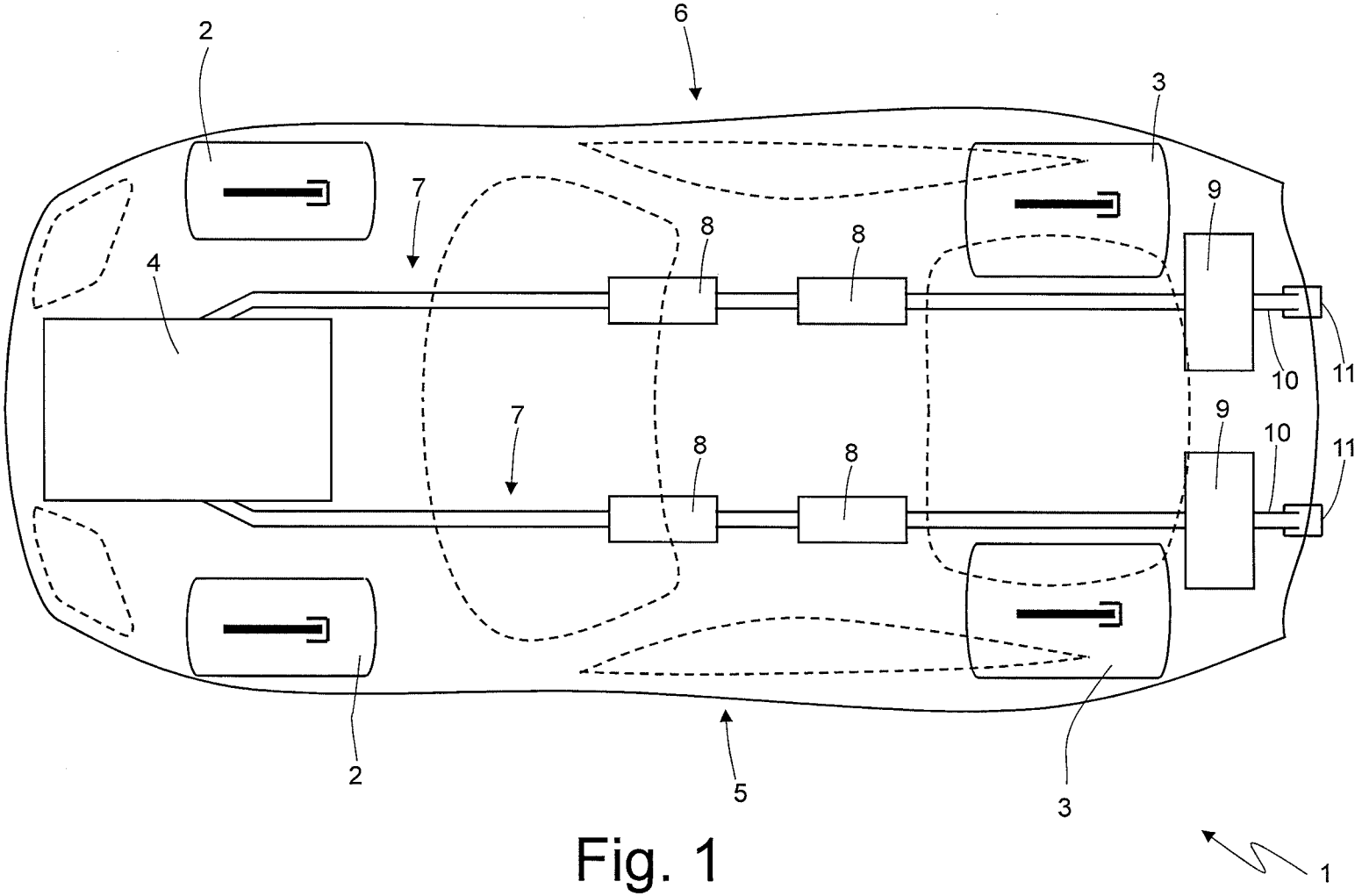
FIG. 1 is a schematic view of a car which is made in accordance with the present invention, has an internal combustion engine, and is provided with a device for the transmission of the exhaust noise.

In FIG. 1, the numeral 1 indicates, as a whole, a car equipped with two front wheels 2 and two rear driving wheels 3, which receive the driving torque from a combustion heat engine 4 arranged in the front. The car 1 is provided with a passenger compartment 5 which is adapted to accommodate the driver and any passengers.

The internal combustion heat engine 4 has two rows of cylinders (not shown) arranged mutually angled to form a "V"; each row of cylinders comprises its own exhaust manifold, which collects the combustion-produced gases that cyclically flow out of the exhaust valves. An exhaust system 6 is provided, which receives the gases produced by combustion from the two exhaust manifolds and releases them into the atmosphere. The exhaust system 6 comprises two twin exhaust pipes 7 (i.e. symmetrical to each other), each of which is connected to a corresponding exhaust manifold (not shown), and ends at the tail of the car 1 (generally housed in the rear bumper).

Along each exhaust pipe 7 there are several exhaust gas treatment devices 8 of the known type: there is always at least one catalyst and there could also be an anti-particulate filter (to meet the new EURO6C regulations on pollutant emissions, car manufacturers provide for the use of an anti-particulate filter—called GPF that stands for "Gasoline Particulate Filter"—even in the case of petrol engines). At the end of each exhaust pipe 7 there is a silencer 9 provided with an outlet pipe 10 constituting the end portion of the exhaust system 6. Each outlet pipe 10 is coupled to a decorative tubular (i.e. tube-shaped) tail pipe 11 only having an aesthetic function (i.e. masking the outlet pipe 10 with a pleasant shape consistent with the layout of the car 1); in other words, each decorative tail pipe 11 is a tubular body (i.e., in the final analysis, a tube) which covers the end portion of the corresponding outlet pipe 10 without touching (i.e. without any point of contact with) said outlet pipe 10. Thus, each decorative tail pipe 11 is a tubular body, which has a size (diameter) greater than the corresponding outlet pipe 10, and partially covers the outlet pipe 10 without touching (i.e. without any point of contact with) said outlet pipe 10.

Figure 2:
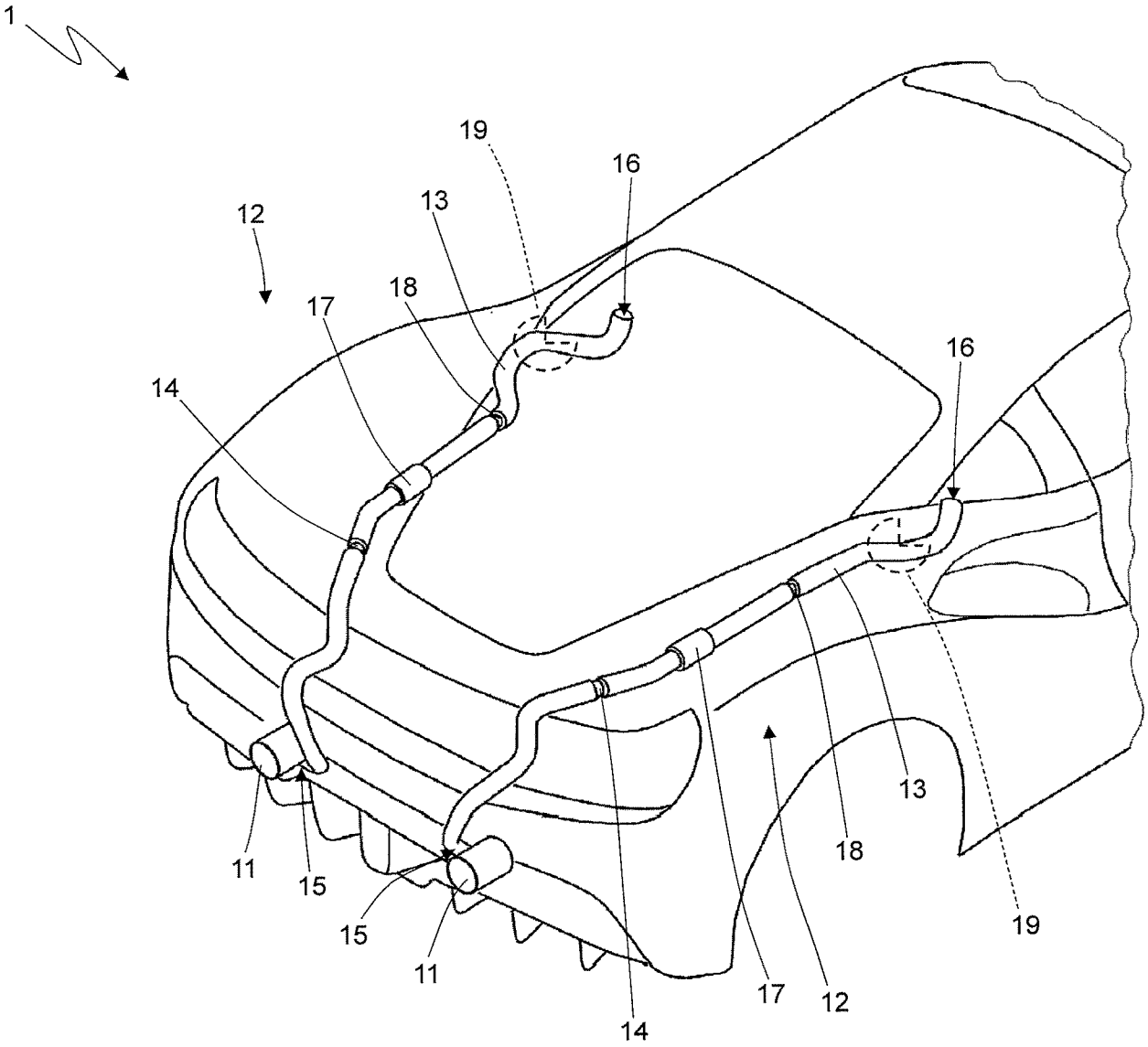
FIG. 2 is a schematic and perspective view of a rear part of the car of FIG. 1 showing the device for the transmission of the exhaust noise.
Figure 3:
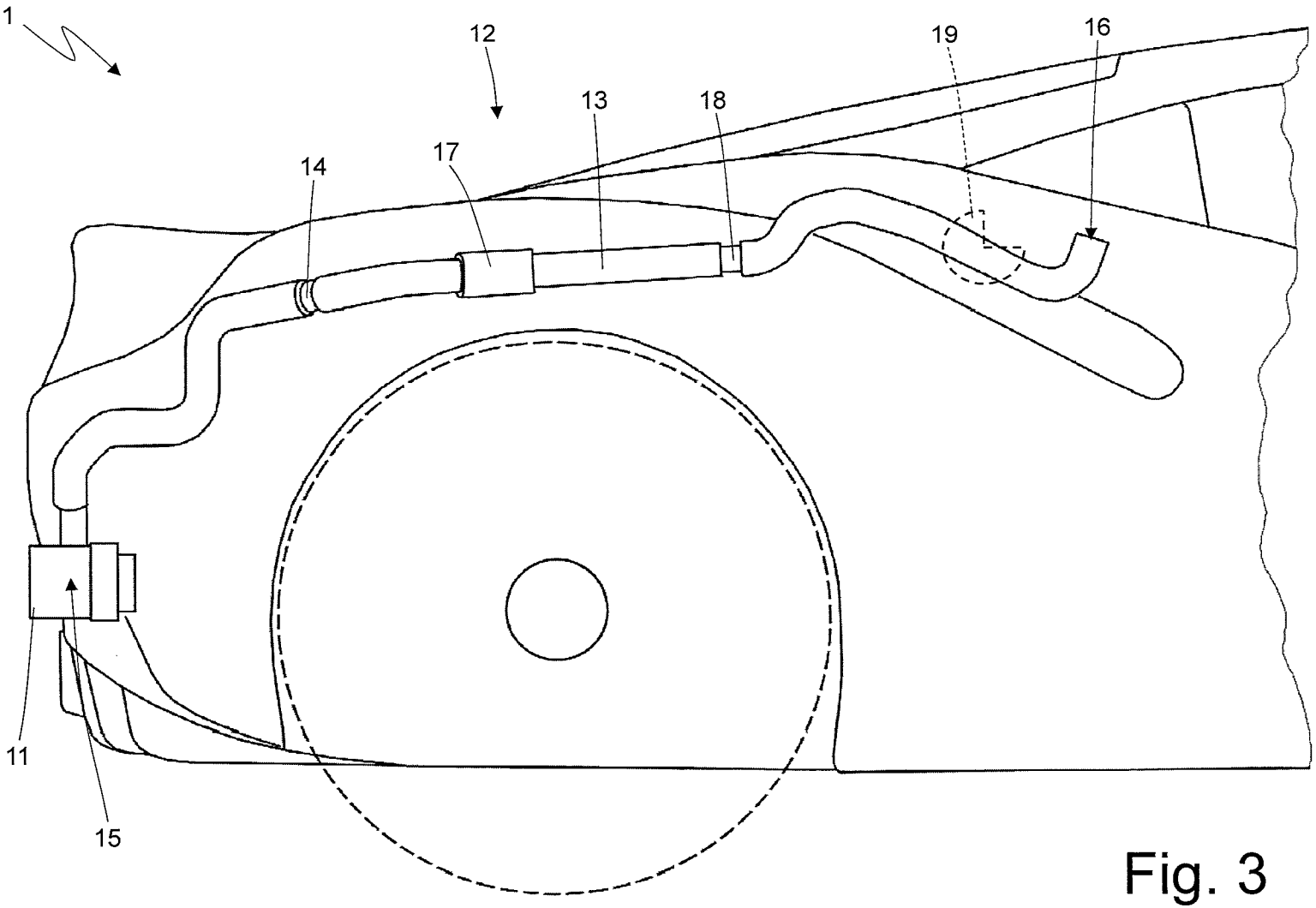
FIG. 3 is a schematic and side view of a rear part of the car of FIG. 1 showing the device for the transmission of the exhaust noise.

As shown in FIGS. 2 and 3, the car 1 comprises a pair of twin devices 12 for the transmission of the exhaust noise (preferably, but not necessarily, symmetrical to each other), each of which is coupled to a corresponding exhaust pipe 7 of the exhaust system 6, and in particular coupled to a corresponding outlet pipe 10 (physically coupled to the decorative tail pipe 11 of the corresponding outlet pipe 10). Each device 12 for the transmission of the exhaust noise comprises a transmission conduit 13, which originates close to the outlet pipe 10 of the silencer 9, ends in the area of a wall of the passenger compartment 5, and is provided, on the inside, with at least one insulating element 14, which is arranged inside the transmission conduit 13 so as to tightly seal the said transmission conduit 13, allowing, at the same time, sound transmission (a plurality of redundant insulating elements 14 can be provided in series to have a better seal guarantee). In other words, the insulating element 14 is pneumatically insulating (i.e. it blocks the passage of gas by tight sealing) and is acoustically permeable (i.e. it allows the passage of sound).

In particular, the transmission conduit 13 comprises an inlet 15, which is arranged close to the outlet pipe 10 of the silencer 9, and an outlet 16, which is opposite to the inlet 15, points towards the passenger compartment 5, and faces a wall of the passenger compartment 5 (i.e. a panel delimiting the passenger compartment 5). In the case of an internal combustion engine 4 arranged in the front (as shown in the attached figures), the outlet 16 of the transmission conduit 13 is facing and close to a wall of the rear luggage compartment; in the case of an internal combustion engine 4 arranged in a central/rear position, the outlet 16 of the transmission conduit 13 is facing and close to the firewall (which is that part of the bodywork separating the engine compartment from the passenger compartment 5 with the purpose of protecting the passenger compartment 5 from heat, smells, and noise generated by the internal combustion engine 4).

The function of each insulating element 14 is to prevent the transmission conduit 13 from releasing the exhaust gases into the car 1 and/or towards the passenger compartment 5, and it performs this function by tight sealing said transmission conduit 13; in this way, the exhaust gases cannot in any way circulate along the transmission conduit 13, the which exhaust gases stop at the insulating element 14. It is important to emphasize that each transmission conduit 13 only has an acoustic function (i.e. it has no effect on the flow of the exhaust gases in the exhaust system 6).

According to a possible, but non-limiting, embodiment, the insulating element 14 comprises a flexible membrane (for example made of silicone), which locally seals the transmission conduit 13 and is free to deform so as to prevent the passage of the exhaust gases and to allow, at the same time, transmission of the sound waves. According to an alternative embodiment, the insulating element 14 comprises a rigid membrane (i.e. of a rigid plastic material) and an elastic ring element (which may be flat or cup-shaped) which is arranged around the rigid membrane and fixed to an inner wall of the transmission conduit 13, so as to cause the rigid membrane to be suspended inside the transmission conduit 13; in this manner, the membrane is suspended inside the transmission conduit 13 and is free to oscillate under the thrust of the pressure pulsations.

According to a preferred, but non-limiting, embodiment illustrated in the attached figures, each transmission conduit 13 comprises a sound filtering device 17 of the low-pass type, which is arranged along the transmission conduit 13 downstream of the insulating element 14. According to a possible and non-limiting embodiment, the filtering device 17 comprises a Helmholtz resonator.

According to a preferred, but non-limiting, embodiment illustrated in the attached figures, each transmission conduit 13 comprises a further sound filtering device 18 of the low-pass type, which is arranged along the transmission conduit 13 downstream of the sound filtering device 17 (therefore downstream of the insulating element 14). According to a possible and non-limiting embodiment, the filtering device 18 comprises a spongy body arranged along the transmission conduit 13.

According to a possible, but non-limiting, embodiment, the sound filtering devices 17 and 18 (in particular the sound filtering device 17) improve the quality and cleanliness of the sound by reducing the noise within a frequency range comprised between 1000 and 4000 Hz, which sound to the human ear as whistling, hissing or blowing.

According to a preferred, but non-limiting, embodiment illustrated in the attached figures, each transmission conduit 13 comprises an adjusting valve 19, which is arranged along the transmission conduit 13 downstream of the sound filtering device 18 (therefore downstream of the sound filtering device 17 and downstream of the insulating element 14) and is designed to change the usable section for the passage through said transmission conduit 13. The adjusting valve 19 is, for example, a throttle valve and is provided with an electrically operated actuator so as to be remotely controlled by an electronic control unit. The adjusting valve 19 is movable between a closed position, in which it closes the passage (i.e. it deletes the usable passage section) through the transmission conduit 13 by minimizing sound transmission along the transmission conduit 13 and towards the passenger compartment 5, and a fully open position, in which it maximizes the usable section for the passage through the transmission conduit 13 by maximizing sound transmission along the transmission conduit 13 and towards the passenger compartment 5. The adjusting valve 19 may take only two positions (i.e. the closed position and the fully open position) or it may also be capable of assuming intermediate positions between the closed position and the fully open position.

By way of example, each adjusting valve 19 could be controlled according to the driving settings selected by the driver (for example, to increase the sound intensity perceived inside the passenger compartment 5 when choosing a sporty driving and to reduce the sound intensity perceived inside the passenger compartment 5 when choosing a comfortable ride). In addition, each adjusting valve 19 could be controlled according to the number of revolutions of the internal combustion engine 4 to "reinforce" the sound intensity perceived inside the passenger compartment 5 when needed. Each adjusting valve 19 could also be controlled according to the position of the accelerator pedal to increase the sound intensity perceived inside the passenger compartment 5 when the driver presses down on the accelerator pedal.

In the case in which there are several insulating elements 14, the sound filtering devices 17 and 18 and the adjusting valve 19 may be arranged downstream of all the insulating elements 14 or may be interposed between the said insulating elements 14.

Figure 4:
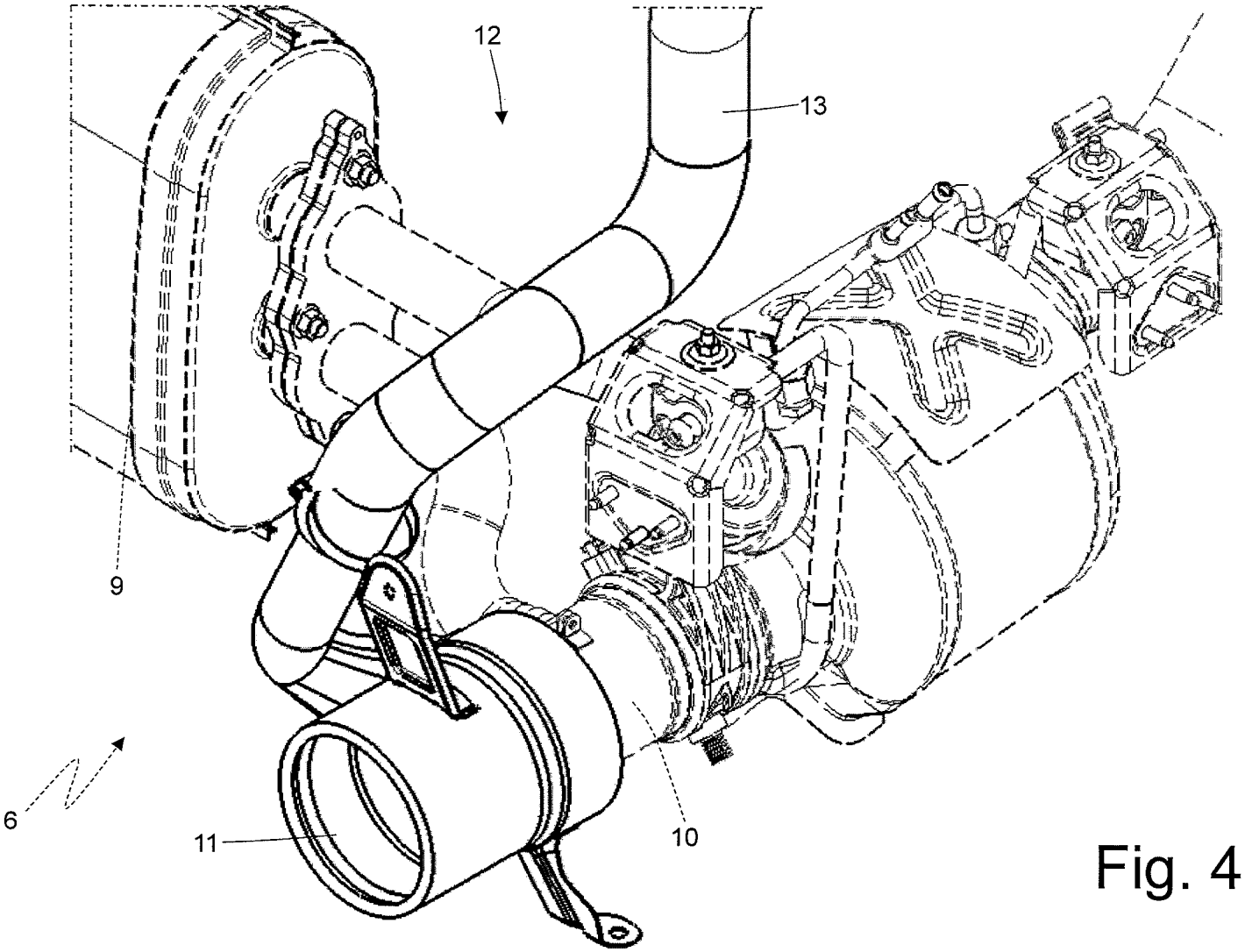
FIGS. 4 and 5 are two perspective views of an end area of an exhaust pipe of the internal combustion engine of FIG. 1.
Figure 5:
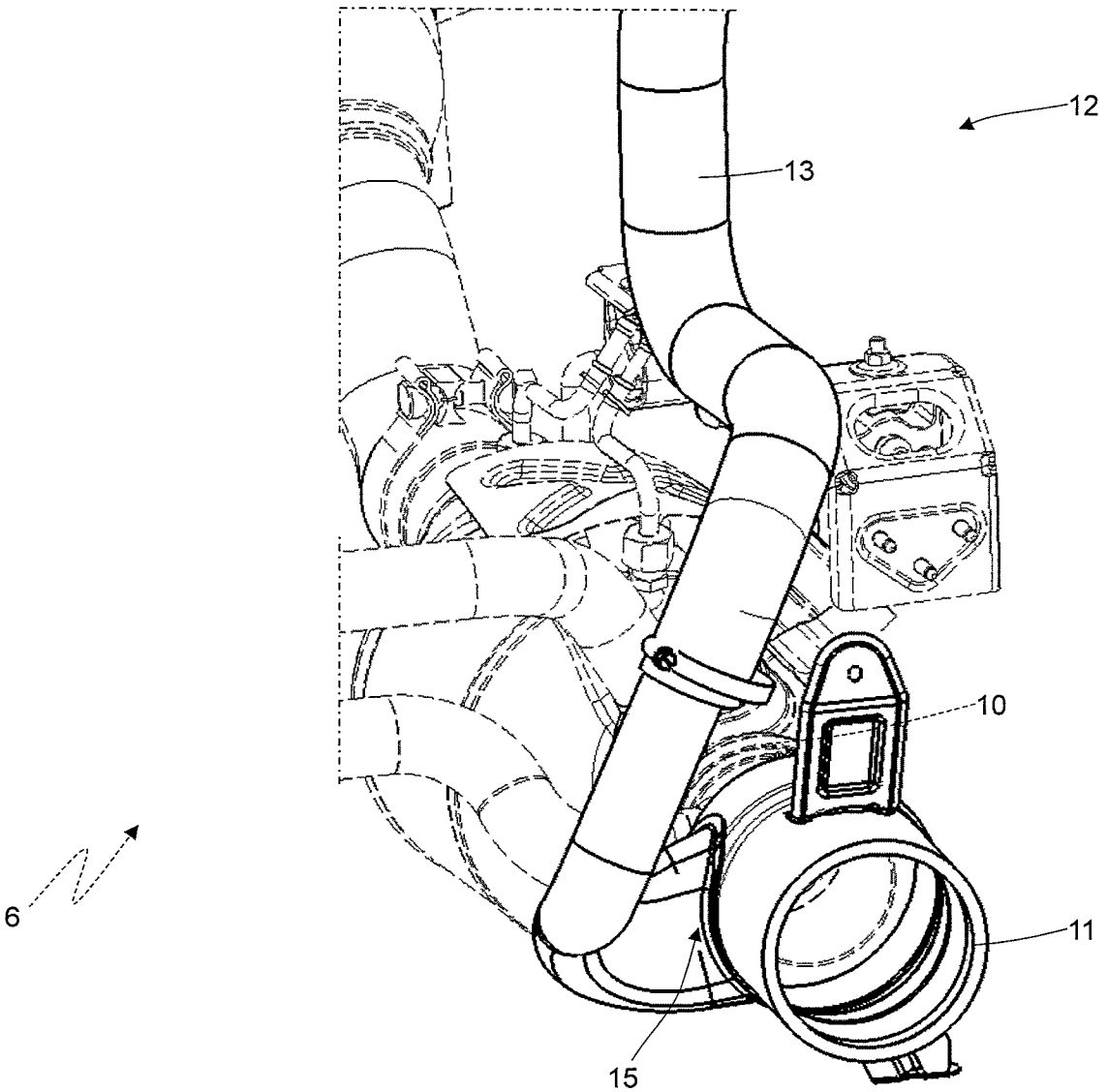
Figure 6:
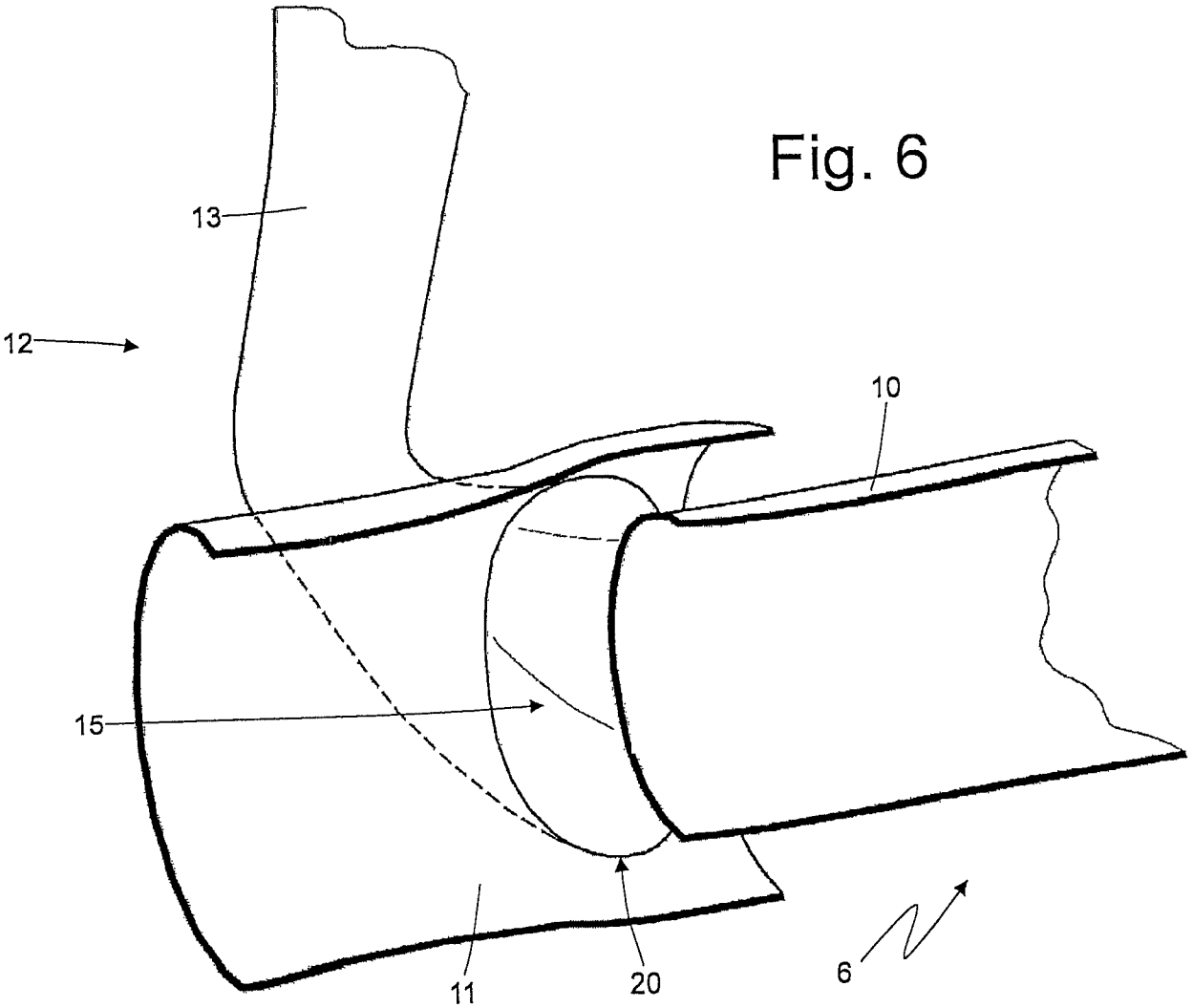
FIG. 6 is a view in longitudinal section of the end area of the exhaust pipe of FIGS. 4 and 5.
Figure 7:
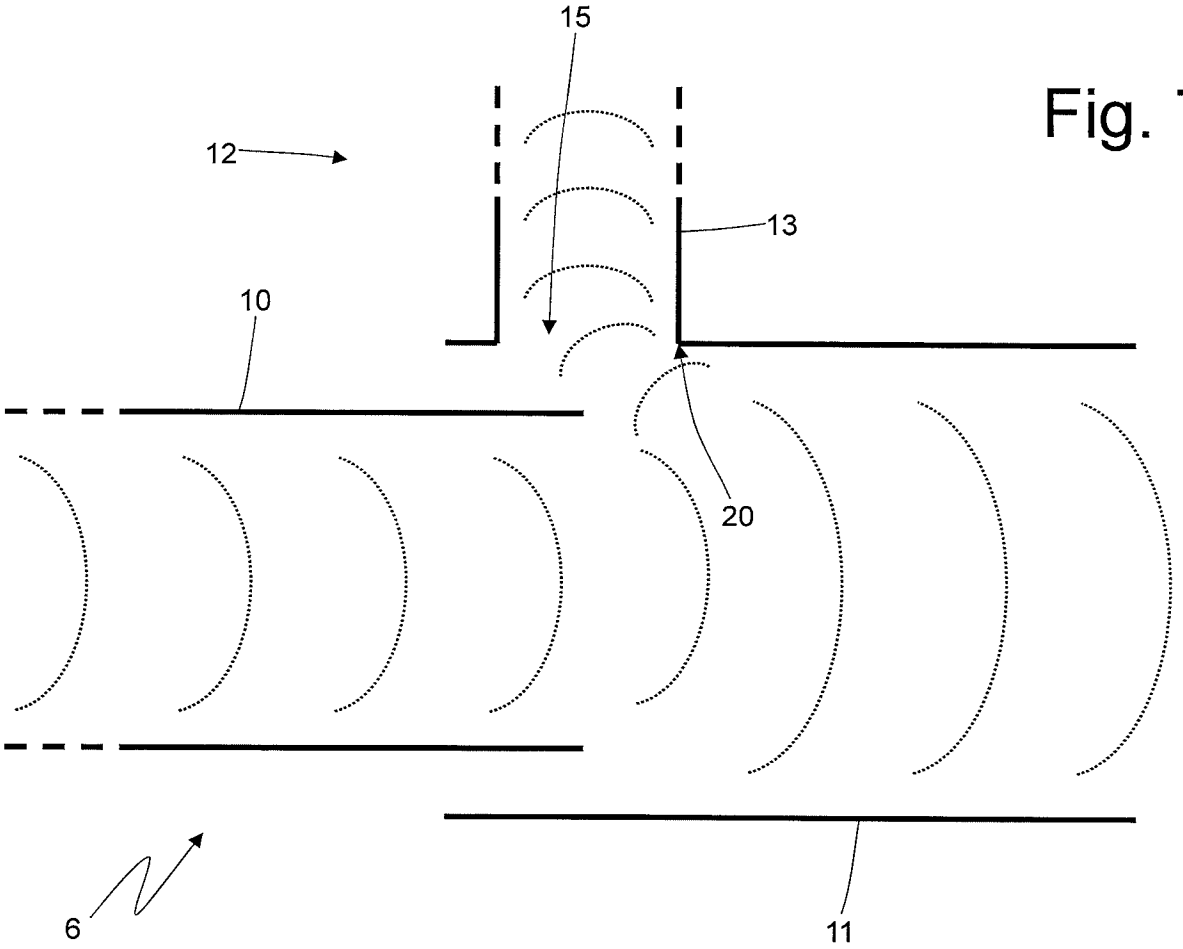
FIG. 7 is a schematic view showing the sound wave paths in the end area of the exhaust pipe of FIGS. 4 and 5.

As illustrated in FIGS. 4, 5 and 6, each decorative tail pipe 11 is coupled to the outlet pipe 10 of the silencer 9 and has, on the side (i.e. through the side wall), a through opening 20 from which the transmission conduit 13 originates, i.e. at which the inlet 15 of the transmission conduit 13 is located; in other words, the transmission conduit 13 is integral with the decorative tail pipe 11 and is connected (fixed) to the decorative tail pipe 11 itself around the through opening (20). Each outlet pipe 10 of the silencer 9 is partially inserted inside the decorative tail pipe 11 and does not touch said decorative tail pipe 11; in other words, each decorative tail pipe 11 is wider than the outlet pipe 10 of the silencer 9 and houses, on the inside without mutual contact, one terminal end of said outlet pipe 10. The opening 20 passing through the side wall of the decorative tail pipe 11 is arranged in the area of the terminal end of the outlet pipe 10 of the silencer 9, as clearly shown in FIG. 6.

By arranging the inlet 15 of each transmission conduit 13 in the area of the respective decorative tail pipe 11, the exhaust gases that enter each transmission conduit 13 (and go up to the insulating element 14) have a reduced pulsating pressure (almost ambient pressure) and a non-excessively high temperature; in this way, each transmission conduit 13 is subjected to relatively low thermal and mechanical stresses.

According to a different embodiment, not shown, each transmission conduit 13 could originate directly from the respective outlet pipe 10 instead of originating from the respective decorative tail pipe 11. However, in this case, the exhaust gases that enter each transmission conduit 13 (and go up to the insulating element 14) are hotter and at a higher pressure and thus subject each transmission conduit 13 to higher thermal and mechanical stresses.

Each exhaust noise transmission device 12 serves the purpose of increasing (amplifying) the exhaust noise perceived inside the passenger compartment 5, so that the overall noise generated by the internal combustion engine 4 and perceived by the occupants of the car 1 is more "pleasant", i.e. more compliant with the desires/expectations of the occupants of the vehicle. Therefore, the presence of the exhaust noise transmission devices 12 makes it possible to remedy the penalization in the exhaust noise caused by the presence of turbines (in the case of turbocharged engines) and by the presence of the exhaust gas treatment devices 8 required by the new EURO6C regulations on pollutant emissions.

The presence of the exhaust noise transmission devices 12 is particularly useful in the case of turbocharged engines since it allows for enhancing the exhaust noise otherwise attenuated by the turbine arranged along the exhaust pipe. Moreover, the presence of the devices 12 for the transmission of the intake noise is particularly useful in the case of turbo-compression since the presence of the compressor in the intake system further attenuates (compared to a similar naturally aspirated engine) the sound level generated by the internal combustion engine 4.

The above-described car 1 provided with the exhaust noise transmission devices 12 has many advantages.

Firstly, the exhaust noise transmission devices 12 allow the exhaust noise from the internal combustion engine 4 to be better targeted towards the passenger compartment 5 (and thus enhanced) with a mode that is extremely pleasant (and therefore appreciated) to/by the occupants of the passenger compartment 5. This result is obtained thanks to the fact that the exhaust noise, however, follows the natural exit path and is "taken" when it comes out of the outlet pipes 10 of the silencers 9 and then (partially) transmitted towards the passenger compartment 5; in other words, the exhaust noise is not artificially "fired" towards the passenger compartment 5 through artificial transmission conduits, but, on the contrary, the exhaust noise reaches the passenger compartment 5 only by passing through the entire exhaust system 6, i.e. following the natural exit path of the exhaust noise.

In addition, the exhaust noise transmission devices 12 are simple and economical to manufacture, since each one essentially consists of a tube (the transmission conduit 13), which is easy to assemble and to integrate into the car 1.

The invention claimed is:

1. A road vehicle comprising:

a passenger compartment;

an internal combustion engine;

an exhaust system, which releases into the atmosphere the gases generated by the combustion, is connected to the internal combustion engine, and ends with at least one silencer provided with at least one outlet pipe, through which the gases generated by the combustion flow out of the exhaust system; and an exhaust noise transmission device, which is provided with a transmission conduit, which originates close to the outlet pipe of the silencer, ends in the area of a wall of the passenger compartment, and is provided, on the inside, with at least one insulating element, which is pneumatically insulating, acoustically permeable, and arranged inside the transmission conduit so as to pneumatically seal the transmission conduit;

wherein a decorative tubular tail pipe surrounding the outlet pipe of the silencer is provided, so that the outlet pipe of the silencer is partially inserted inside the decorative tail pipe and does not touch said decorative tail pipe;

wherein the decorative tail pipe is wider than the outlet pipe and houses, on the inside without mutual contact, a terminal end of said outlet pipe;

wherein the decorative tail pipe has, on the side, a through opening from which the transmission conduit originates; and wherein the through opening is made through a side wall of the decorative tail pipe arranged in the area of the terminal end of the outlet pipe of the silencer.

2. The road vehicle according to claim 1, wherein the transmission conduit is integral with the decorative tail pipe and is connected to the decorative tail pipe around the through opening.

3. The road vehicle according to claim 1, wherein the insulating element comprises a flexible membrane, which locally seals the transmission conduit.

4. The road vehicle according to claim 1, wherein the insulating element comprises:

a rigid membrane; and an elastic element, which is arranged around the rigid membrane and is fixed to an inner wall of the transmission conduit, so as to cause the rigid membrane to be suspended inside the transmission conduit.

5. The road vehicle according to claim 1 and comprising a first sound filtering device of the low-pass type, which is arranged along the transmission conduit downstream of the insulating element.

6. The road vehicle according to claim 5, wherein the first filtering device comprises a spongy body, which is arranged along the transmission conduit.

7. The road vehicle according to claim 1 and comprising a second sound filtering device of the low-pass type, which is arranged along the transmission conduit downstream of the insulating element.

8. The road vehicle according to claim 7, wherein the second filtering device comprises a Helmholtz resonator.

9. The road vehicle according to claim 1 and comprising an adjusting valve, which is arranged along the transmission conduit downstream of the insulating element and is designed to change the usable section for the passage through the transmission conduit.

10. The road vehicle according to claim 9 and comprising at least one sound filtering device of the low-pass type, which is arranged along the transmission conduit downstream of the insulating element and upstream of the adjusting valve.

* * * * *